US008371672B2

(12) United States Patent
Kusakabe

(10) Patent No.: US 8,371,672 B2
(45) Date of Patent: Feb. 12, 2013

(54) PRINTING APPARATUS AND METHOD FOR DUPLEX PRINTING

(75) Inventor: Taketoshi Kusakabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 12/957,256

(22) Filed: Nov. 30, 2010

(65) Prior Publication Data

US 2011/0211003 A1 Sep. 1, 2011

(30) Foreign Application Priority Data

Feb. 26, 2010 (JP) ..... 2010-042336

(51) Int. Cl.
*B41J 29/38* (2006.01)

(52) U.S. Cl. ..... 347/14

(58) Field of Classification Search ..... None
See application file for complete search history.

(56) References Cited

FOREIGN PATENT DOCUMENTS

| | | | |
|---|---|---|---|
| JP | 07-264348 | A | 10/1995 |
| JP | 11-249346 | A | 9/1999 |
| JP | 2001-233543 | A | 8/2001 |
| JP | 2003-039750 | A | 2/2003 |
| JP | 2008-126530 | A | 6/2008 |
| JP | 2008-149657 | A | 7/2008 |
| JP | 2008149657 | A * | 7/2008 |

* cited by examiner

*Primary Examiner* — Geoffrey Mruk
*Assistant Examiner* — Bradley Thies
(74) *Attorney, Agent, or Firm* — Canon USA, Inc. IP Divison

(57) ABSTRACT

Images are sequentially printed on a first surface of a sheet, and identification information for identifying an image is formed each time an image is printed. When printing is interrupted by the error and before resuming printing, the identification information formed on the first surface of the sheet fed from the reverse unit again is read by the reader, and an image to be printed on the second surface when resuming printing is specified based on the read identification information.

10 Claims, 9 Drawing Sheets

PRINTING APPARATUS AND METHOD FOR DUPLEX PRINTING

BACKGROUND OF THE INVENTION

1. Field of the Invention

The present invention relates to a printing apparatus using a continuous sheet.

2. Description of the Related Art

Japanese Patent Laid-Open No. 2008-126530 describes a printing apparatus that performing inkjet duplex printing on the front and back sides of a sheet, which is a long sheet wound into a roll.

The apparatus according to Japanese Patent Laid-Open No. 2008-126530 does not take into consideration error recovery in case printing is interrupted due to an error, such as jamming of a sheet being conveyed (hereinafter simply referred to as "jamming"). Therefore, when printing is interrupted, the user has to remove all of sheet left inside the apparatus and restart the printing from the beginning. That is, when jamming occurs, large amounts of printing sheets and ink are wasted.

SUMMARY OF THE INVENTION

The present invention has been conceived in light of the problem described above. The present invention provides a printing apparatus that is capable of resuming duplex printing even when printing is interrupted by an error while minimizing the waste in printing sheets and ink.

The present invention provides an apparatus for duplex printing including a sheet feeding unit configured to feed a continuous sheet; a printing unit configured to perform printing on the sheet; a reverse unit configured to reverse the sheet for the duplex printing; a reader configured to read identification information formed on the sheet; and a control unit, wherein the control unit controls the apparatus such that, the printing unit prints a plurality of images and identification information for identifying each of the images, on a first surface of the sheet fed from the sheet feeding unit, the reverse unit stores the sheet printed on the first surface and feeds the reversed sheet to the printing unit, the printing unit prints a plurality of images on a second surface that is a back of the first surface of the sheet fed from the reverse unit, and, when printing is interrupted by an error and before resuming printing, the reader reads the identification information formed on the first surface of the sheet fed from the reverse unit, and the control unit specifies an image to be printed on the second surface for resuming based on the read identification information.

According to the present invention, even when duplex printing is interrupted due to an error, by resuming back-side printing by saving as many front-side printed sheets as possible, waste in sheets and ink can be minimized.

Further features of the present invention will become apparent from the following description of exemplary embodiments with reference to the attached drawings.

DESCRIPTION OF THE EMBODIMENTS

An inkjet printing apparatus according to an embodiment will be described below. The printing apparatus according to this embodiment is a high-speed line printer capable of simplex printing and duplex printing and uses a long continuous sheet (i.e., a long continuous sheet whose length in the conveying direction is longer than the length of repeated printing units (referred to as "pages" or "unit images")). The printing apparatus is suitable for use in, for example, a print lab where a large number of printouts are made. In this specification, a printing unit (page) is referred to as a unit image even when multiple images, characters, and/or blanks are included in the area corresponding to the printing unit. In other words, a unit image is a printing unit (page) used when a plurality of pages is sequentially printed on a continuous sheet. Instead of the term "unit image," the term "image" may be simply used. The length of a unit image varies in accordance with the size of the image to be printed. For example, the length of an L-size photograph in the sheet conveying direction is 135 mm, whereas the length of A-size photograph in the sheet conveying direction is 297 mm.

Figure 1:
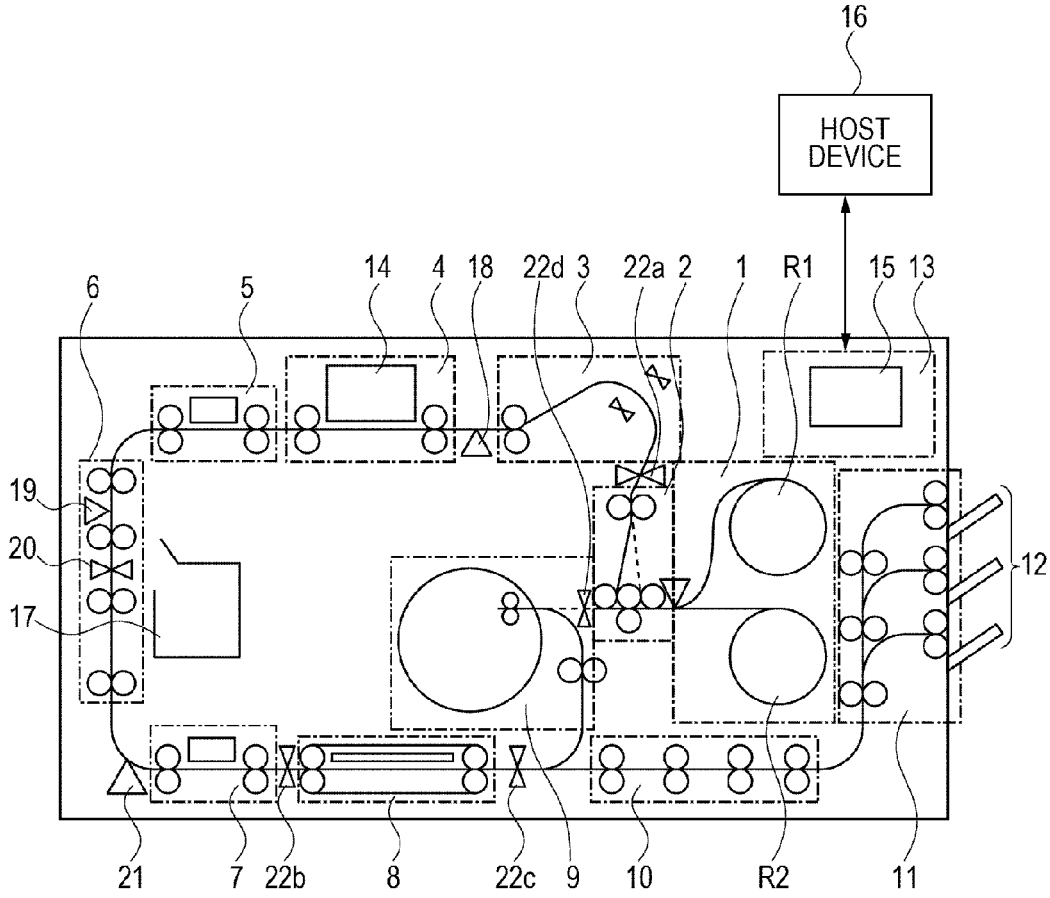
FIG. 1 is a schematic view illustrating the internal configuration of a printing apparatus.

FIG. 1 is a sectional schematic view of the internal configuration of a printing apparatus. The printing apparatus according to this embodiment is capable of performing duplex printing on a first surface and a second surface of a sheet wound into a roll. The main units stored in the printing apparatus include a sheet feeding unit 1, a decurling unit 2, a skew correction unit 3, a printing unit 4, an inspection unit 5, a cutter unit 6, an information recording unit 7, a drying unit 8, a reverse unit 9, an ejection conveying unit 10, a sorter unit 11, an ejection unit 12, and a control unit 13. The sheet conveyed through a sheet conveying path, which is indicated by a solid line in the drawing, by a conveying mechanism including paired rollers and belts and is processed at each unit. In the sheet conveying path, positions on the side closer to the sheet feeding unit 1 is referred to upstream positions and positions on the opposite side are referred to as downstream positions.

The sheet feeding unit 1 is a unit that retains and supplies a continuous sheet wound into a roll. The sheet feeding unit 1 is capable of accommodating two rolls R1 and R2 and selects one of the rolls to reel out and feed the sheet. The number of rolls to be stored is not limited to two and, instead, may be one roll or three or more rolls. The sheet is not limited to a rolled sheet so long as it is a continuous sheet. For example, a continuous sheet having perforations at intervals equal to a unit length may be folded at the perforations into a stack and stored in the sheet feeding unit 1.

The decurling unit 2 is a unit that reduces the curling (warping) of the sheet fed from the sheet feeding unit 1. The decurling unit 2 uses one driving roller and two pinch rollers to apply a decurling force to the sheet by warps the sheet in a direction opposite to that of the curling.

The skew correction unit 3 is a unit that corrects the obliqueness (inclination relative to the proper conveying direction) of the sheet that has passed through the decurling unit 2. The obliqueness of the sheet is corrected by pushing a guide member against the edge of the sheet that is used as a reference.

The printing unit 4 is a sheet processing unit that forms an image by performing printing on the sheet from the top side of the conveyed sheet with a print-head unit 14. The printing unit 4 includes a plurality of conveying rollers that convey the sheet. The print-head unit 14 includes a line print-head unit provided with an inkjet nozzle array that covers the maximum width of the sheet to be used. The print-head unit 14 includes a plurality of print heads arranged in parallel in the conveying direction. In this embodiment, seven print heads corresponding to seven colors, cyan (c), magenta (M), yellow (Y), light cyan (LC), gray (G), and black (K) are provided. However, the number of colors and print heads is not limited to seven. The inkjet method may be a method using a heater element, a piezoelectric element, an electrostatic element, or an MEMS element. Colored ink is fed from the ink tanks to the print-head unit 14 through corresponding ink tubes.

The inspection unit 5 is a unit that optically reads inspection patterns and images printed on the sheet by the printing unit 4 using a scanner and determines whether or not an image is correctly printed by inspecting the nozzle condition of the print heads, the sheet conveying condition, the image position, and so on. The scanner includes a CCD image sensor or a CMOS image sensor.

The cutter unit 6 is a unit including a mechanical cutter (automatic cutter) that cuts by the driving force of a motor the printed sheet at cutting positions at intervals of predetermined lengths. The cutter unit 6 includes a plurality of conveying rollers that sends out the sheet to the next process. A waste box 17 is provided in the vicinity of the cutter unit 6. The waste box 17 where sheet fragments cut off at the cutter unit 6 are ejected as waste. The cutter unit 6 has a sorting mechanism for selecting between ejecting a cut sheet to the waste box 17 and sending the cut sheet to the regular conveying path.

In addition to the automatic cutter, manual cutters 22 used by a user to manually cut a sheet are provided at least between the reverse unit 9 and the printing unit 4. When an error, such as jamming of the sheet, requiring cutting of the sheet occurs, at least one of the manual cutters 22 is operated by the user to cut the sheet and remove it from inside the apparatus housing. In this embodiment, the manual cutters 22 are installed at four positions: between the print-head unit 14 and the skew correction unit 3 (22*a*); before and after the drying unit 8 (22*b* and 22*c*); and between the reverse unit 9 and the decurling unit 2. In other words, two manual cutters 22 are provided between the reverse unit 9 and the printing unit 4. However, the number and positions of the manual cutters 22 are not limited.

The information recording unit 7 is a unit that records printing information (unique information), such as serial numbers and dates, in the non-printing area on the cut sheet. Recording is performed by printing characters and codes using inkjet printing or thermal transfer printing. An edge sensor 21 that detects the front edge of a cut sheet is provided at a position that is upstream of the information recording unit 7 and downstream of the cutter unit 6. That is, the edge sensor 21 detects the sheet edge between the cutter unit 6 and the recording position of the information recording unit 7, and, on the basis of the detection timing of the edge sensor 21, the timing of recording information at the information recording unit 7 is controlled.

The drying unit 8 is a unit that heat the sheet printed at the printing unit 4 to dry the applied ink in a short amount of time. The ink application surface of the sheet passing through the inside the drying unit 8 is dried by applying hot wind from at least from below the sheet. The drying method is not limited to applying hot wind and, instead, the surface of the sheet may be irradiated with electromagnetic waves (ultraviolet light or infrared light).

The sheet conveying path from the sheet feeding unit 1 to the drying unit 8 is referred to a first path. The first path is a U-shaped path starting from the printing unit 4 and ending at the drying unit 8. The cutter unit 6 is disposed at a bottom section of the U-shape.

The reverse unit 9 is a unit that temporarily winds the continuous sheet on which front-side printing has been completed in the duplex printing mode to reverse the front and back sides. The reverse unit 9 is disposed at a midpoint in a path from the drying unit 8 to the printing unit 4 through the decurling unit 2 (loop path) (which is referred to as a second path). The second path is used to convey the sheet that has passed through the drying unit 8 to the printing unit 4 again. The reverse unit 9 includes a winding rotary member (drum) that rotates to wind the sheet. The uncut continuous sheet on which front-side printing has been performed is temporarily wound by the winding rotary member. When sheet is completely wound, the winding rotary member rotates in the reserve direction to send out the wound sheet and feed the sheet to the decurling unit 2 from where the sheet is sent to the printing unit 4. Since the sides of the sheet are reversed, printing can be performed on the back side by the printing unit 4. Details of the operation of duplex printing will be described below.

The ejection conveying unit 10 is a unit that conveys the sheet cut at the cutter unit 6 and dried at the drying unit 8 to the sorter unit 11. The ejection conveying unit 10 is provided in a path different from the second path in which the reverse unit 9 is disposed (referred to a third path). A path-switching mechanism having a flapper is provided at the connecting point of the paths to selectively guide the sheet that has been conveyed through the first path to the second path or the third path.

The sorter unit 11 and the ejection unit 12 are disposed on the side of the sheet feeding unit 1 and at the end of the third path. The sorter unit 11 is a unit that sorts printed sheets into different groups, when required. The sorted sheets are ejected from the ejection unit 12, which includes a plurality of trays. The third path allows sheet to pass below the sheet feeding unit 1 and be ejected from the side the of the sheet feeding unit 1 opposite to the side closer to the printing unit 4 and the drying unit 8.

As described above, the sheet feeding unit 1 to the drying unit 8 are disposed in order along the first path. After the drying unit 8, the first path branching into the second path and the third path. The reverse unit 9 is disposed at a midpoint of the second path. The second path merges with the first path after the reverse unit 9. The ejection unit 12 is disposed at the end of the third path.

The control unit 13 is a unit that controls all units in the printing apparatus. The control unit 13 includes a CPU, a storage device, a controller having various controlling parts, an external interface 205, and an operating unit 15 operated by the user for input/output. The operation of the printing apparatus is controlled on the basis of instructions from a controller or a host device 16 of a host computer connected to the controller via the external interface 205.

A mark reader 18 is provided between the skew correction unit 3 and the printing unit 4. The mark reader 18 is a reflective optical sensor that optically reads a reference mark recorded on the first surface of a sheet conveyed from the reverse unit 9 from the side opposite to the side on which printing is performed. The mark reader 18 includes a light source for illuminating the sheet surface (for example, a white LED) and an image sensor that detects light from the illuminated sheet surface by each RGB component. The mark reader 18 reads marks by image analysis of the image-pickup data.

Figure 2:
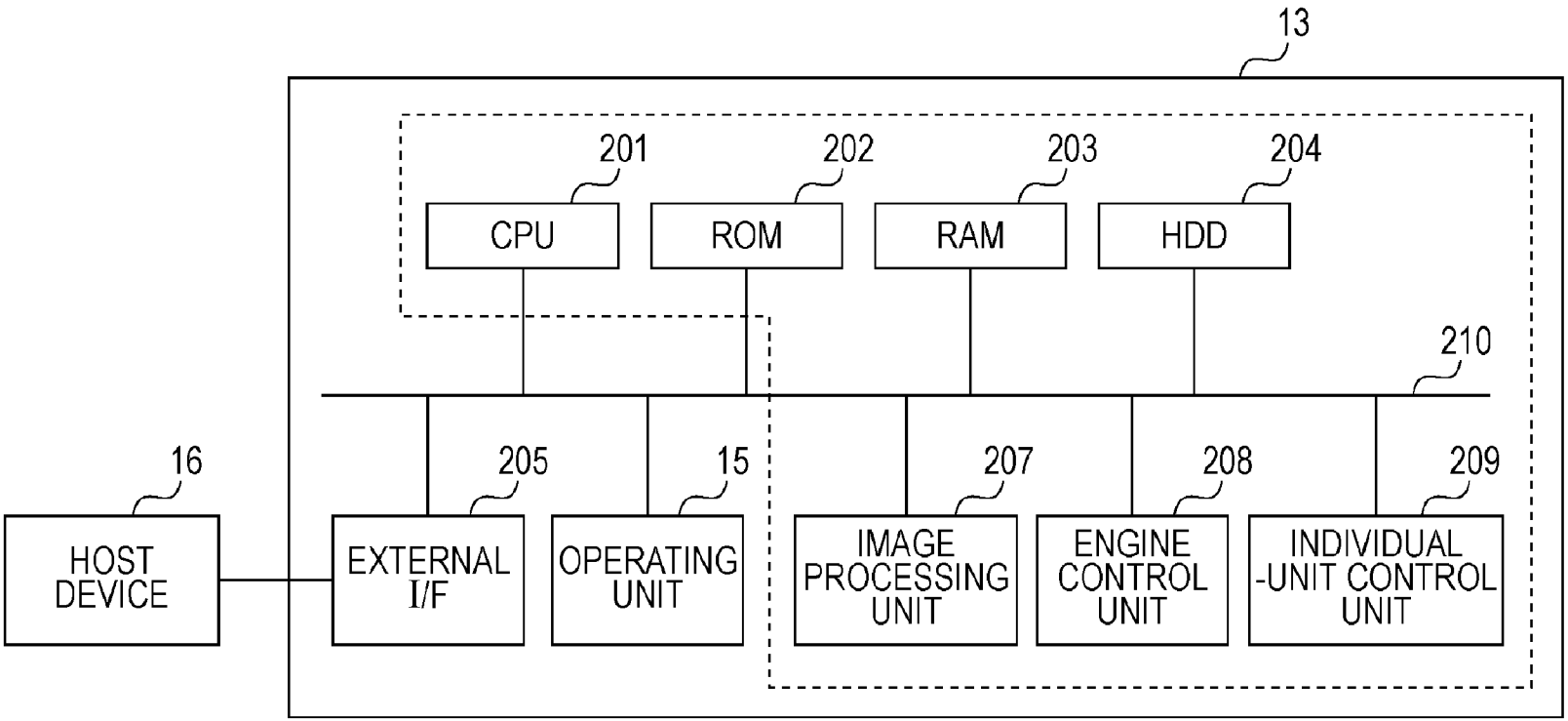
FIG. 2 is a block diagram of a control unit.

FIG. 2 is a block diagram illustrating the concept of the control unit 13. The controller included in the control unit 13 (indicated by the area surrounded by the dotted line) includes a CPU 201, a ROM 202, a RAM 203, an HDD 204, an image processing part 207, an engine controlling part 208, and an individual-unit control part 209. The CPU 201 (central processing unit) carries out integrative control of the operation of the units in the printing apparatus. The ROM 202 holds programs that are executed by the CPU 201 and fixed data that is required for various operations of the printing apparatus. The RAM 203 is used as a work area of the CPU 201, a temporary storage area for various types of received data, and an area for storing various setting data. Programs executed by the CPU 201, print data, and setting information required for various operations of the printing apparatus can be stored in and read out from the HDD 204 (hard disc). The operating unit 15 is an input/output interface for the user and includes an input part, such as hard keys or a touch panel, and an output part, such as a display and/or an audio generator for displaying.

Units that required high-speed data processing are provided with a dedicated processor. The image processing part 207 carries out image processing of print data handled by the printing apparatus. The color space (for example, YCbCr) of the input image data is converted to a typical RGB color space (for example sRGB). Various types of image processing, such as resolution conversion, image analysis, and image correction, are performed on the image data as required. Print data obtained through such image processing is stored in the RAM 203 or the HDD 204. The engine controlling part 208 carries out drive control of the print-head unit 14 of the printing unit 4 in accordance with print data in response to control commands received from the CPU 201 and so on. The engine controlling part 208 also controls the conveying mechanisms provided for the units of the printing apparatus. The individual-unit control part 209 is a sub-controller and individually controls the sheet feeding unit 1, the decurling unit 2, the skew correction unit 3, the inspection unit 5, the cutter unit 6, the information recording unit 7, the drying unit 8, the reverse unit 9, the ejection conveying unit 10, the sorter unit 11, and the ejection unit 12. The operations of the units are controlled by the individual-unit control part 209 in response to instructions from the CPU 201. The external interface 205 is an interface (I/F) connecting the controller to the host device 16 and is a local I/F or a network I/F. The components described above are connected via a system bus 210.

The host device 16 is a supply source of image data to be printed at the printing apparatus. The host device 16 may be a general-purpose or a specialized computer or a specialized image device, such as an image capturer having an image reader, a digital camera, or a photo storage. If the host device 16 is a computer, an OS, application software for generating image data, and a printer driver for the printing apparatus are installed to the storage device included in the computer. It is not essential to realized all the above-described processes by software, and all or part of the processes may be realized by hardware.

Next, the basic operation during printing will be described. Since the printing operations of a simplex printing mode and a duplex printing mode differ, each mode will be described below.

Figure 3A:
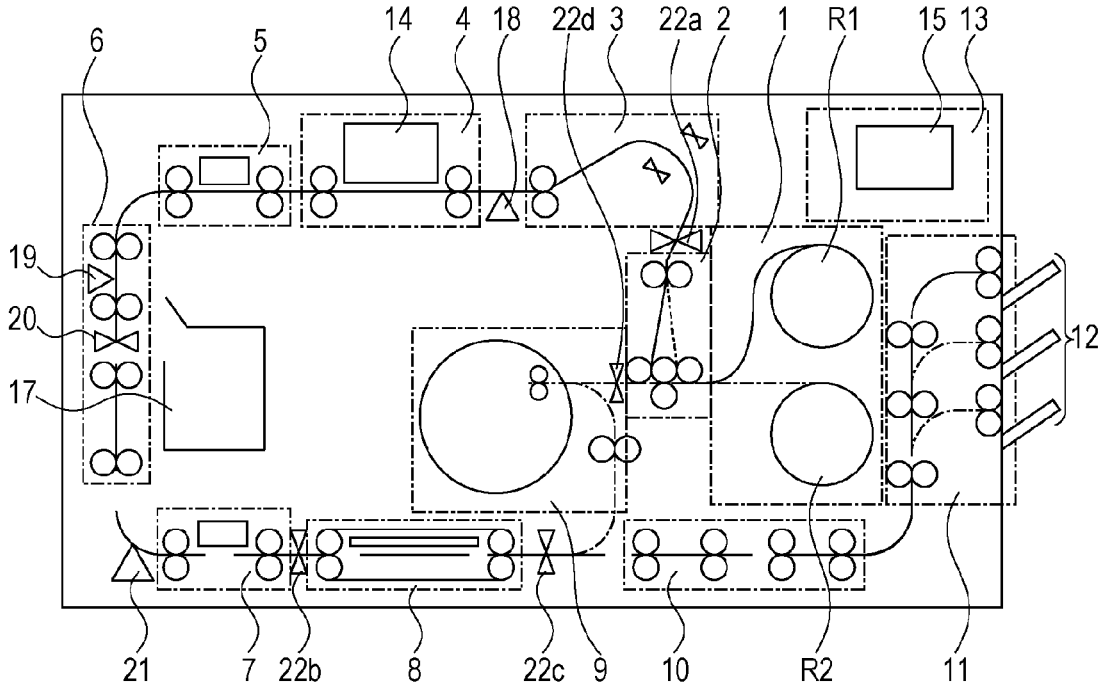
FIGS. 3A and 3B illustrate the operations in simplex printing mode and duplex printing mode, respectively.

FIG. 3A illustrates the operation of a simplex printing mode. Printing is performed by the printing unit 4 on the front side (first surface) of a sheet, which has been fed from the sheet feeding unit 1 and processed at the decurling unit 2 and the skew correction unit 3. Images each having a predetermined unit length in the conveying direction of the continuous sheet are sequentially printed on the sheet adjacent to each other. Margin regions are provided between adjacent images, and cut marks are recorded in the margin regions by the printing unit 4. The printed sheet that has passes through the inspection unit 5 is cut into sheet pieces corresponding to the unit images by a cutter 20 in response to the detection of a cut mark by a cut-mark sensor 19. Print information is recorded on the back side of the cut sheet pieces by the information recording unit 7 as required. Each cut sheet piece is conveyed to the drying unit 8 and dried. Then, the dried cut sheet pieces are sequentially ejected through the ejection conveying unit 10 and stacked in the ejection unit 12 of the sorter unit 11. The sheet remaining in the printing unit 4 after the last image unit is cut off from the sheet is returned to the sheet feeding unit 1, where the remaining sheet is wound by the roll R1 or R2.

In this way, in simplex printing, the sheet passes through and is processed in the first path and the third path and does not enter the second path. In summary, in the simplex printing mode, the following sequence (1) to (6) is performed through control by the control unit 13:

(1) a sheet is sent out from the sheet feeding unit 1 and is fed to the printing unit 4;
(2) unit images and cut marks are repeatedly printed on the first surface of the fed sheet by the printing unit 4;
(3) the sheet is repeatedly cut into pieces corresponding to the unit images printed on the first surface by the cutter unit 6;
(4) each cut sheet piece on which a unit image is printed passes through the drying unit 8;
(5) each cut sheet pieces that has passed through the drying unit 8 passes through the third path and is ejected to the ejection unit 12; and
(6) the sheet remaining in the printing unit 4 after the last unit image is cut is returned to the sheet feeding unit 1.

Figure 3B:
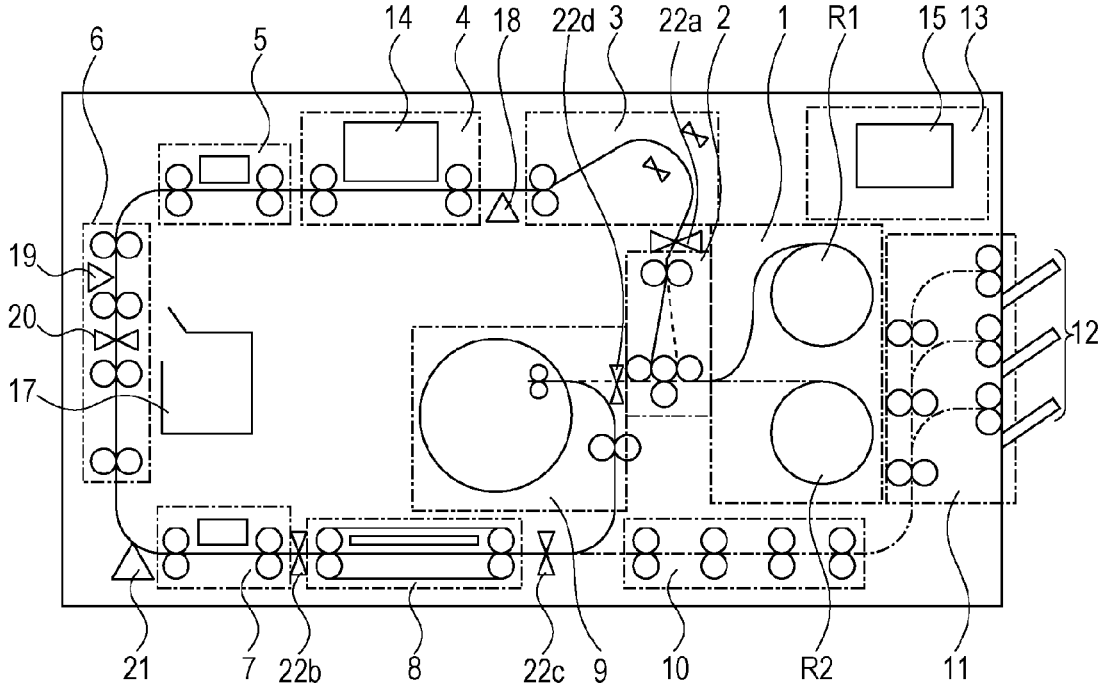

FIG. 3B illustrates the operation in the duplex printing mode. In the duplex printing mode, the back side (second surface) printing sequence is performed after the front side (first surface) printing sequence. The operations of the sheet feeding unit 1 through the inspection unit 5 in the front-side printing sequence are the same as those in the above-described simplex printing sequence. The sheet is not cut by the cutter unit 6 and is conveyed to the drying unit 8 as a continuous sheet. After drying the ink on the front side at the drying unit 8, the sheet is guided to the path to the reverse unit 9 (second path) and does not enter the path (third path) to the ejection conveying unit 10. In the second path, the sheet is wound by the winding rotary member of the reverse unit 9 rotating in the forward direction (counterclockwise in the drawing). When the planned front-side printing is completed by the printing unit 4, the rear edge of the printing area on the continuous sheet is cut by the cutter unit 6. The continuous sheet on the downstream side of the cutting position in the conveying direction (printed portion of the continuous sheet) passes through the drying unit 8 and is entirely wound to its rear edge (cutting position) by the reverse unit 9. Simultaneously as the sheet is being wound, the continuous sheet remaining on the upstream side of the cutting position in the conveying direction is rewound and is wound by the roll R1 or R2 of the sheet feeding unit 1 so that the front edge of the sheet (cutting position) does not remain in the decurling unit 2. The rewinding prevents the sheet from colliding with the other sheet fed again for the back-side printing sequence described below.

After the above-described front-side printing sequence is performed, the back-side printing sequence is performed. The winding rotary member of the reverse unit 9 rotates in a direction opposite to the rewinding direction (i.e., in the clockwise direction in the drawing). The edge of the wound sheet (the rear edge during winding is the front edge during feeding) is fed to the decurling unit 2 through the path indicated by the dotted line in the drawing. Curling caused by the winding rotary member is corrected at the decurling unit 2. That is, the decurling unit 2 is provided between the sheet feeding unit 1 and the printing unit 4 in the first path and between the reverse unit 9 and the printing unit 4. In other words, the decurling unit 2 is a common unit used for straightening the sheet in both paths. The sheet with reversed sides is sent through the skew correction unit 3 to the printing unit 4, where unit images and cut marks are printed on the back side of the sheet. The printed sheet passes through the inspection unit 5 and is cut at the cutter unit 6 into sheet pieces having desired unit length set in advance. Since printing has been performed on both sides of the cut sheet pieces, recording is not performed at the information recording unit 7. The cut sheet pieces are conveyed one by one to the drying unit 8, passed through the ejection conveying unit 10, and sequentially ejected and stacked in the ejection unit 12 of the sorter unit 11.

In duplex printing, the sheet passes through the first path, the second path, and the third path in sequence for processing. In summary, in the simplex printing mode, the following sequence (1) to (11) is performed through control by the control unit 13:

(1) a sheet is sent out from the sheet feeding unit 1 and is fed to the printing unit 4;
(2) unit images are repeatedly printed on first surface of the fed sheet by the printing unit 4;
(3) the sheet on which printing is performed on the first surface passes through the drying unit 8;
(4) the sheet that has passed through the drying unit 8 is guided to the second path and is wound by the winding rotary member of the reverse unit 9;
(5) after repeated printing is performed on the first surface, the sheet is cut by the cutter unit 6 at rear edge of the unit image printed at last;
(6) the sheet is wound by the winding rotary member until the edge of the cut sheet passes through the drying unit 8 and reaches the winding rotary member, and, at the same time, the sheet remaining in the printing unit 4 is returned to the sheet feeding unit 1;
(7) after the sheet is wound, the sheet is fed through the second path to the printing unit 4 again;
(8) unit images and cut marks are repeatedly printed on the second surface of the sheet fed through the second path by the printing unit 4;
(9) the sheet is repeatedly cut by the cutter unit 6 into pieces corresponding to the unit image printed on the second surface;
(10) each cut sheet piece on which a unit image is printed passes through the drying unit 8; and
(11) each sheet piece that has passed through the drying unit 8 passes through the third path and is ejected to the ejection unit 12.

Figure 4A:
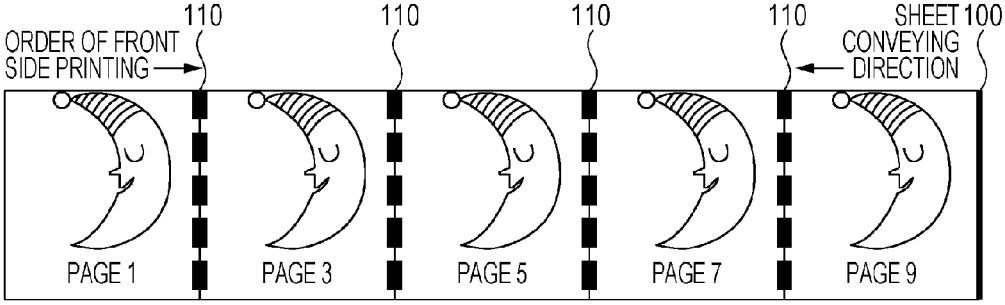
FIGS. 4A, 4B, and 4C illustrate the printing order in duplex printing mode.
Figure 4B:
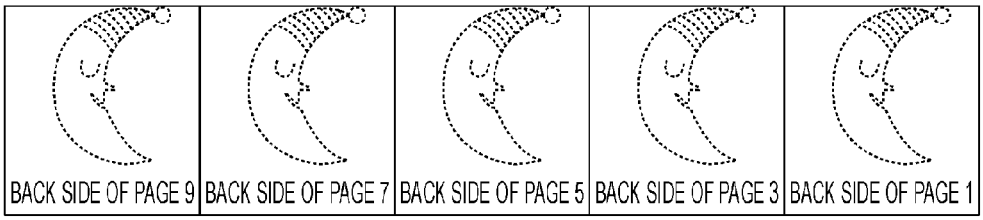
Figure 4C:
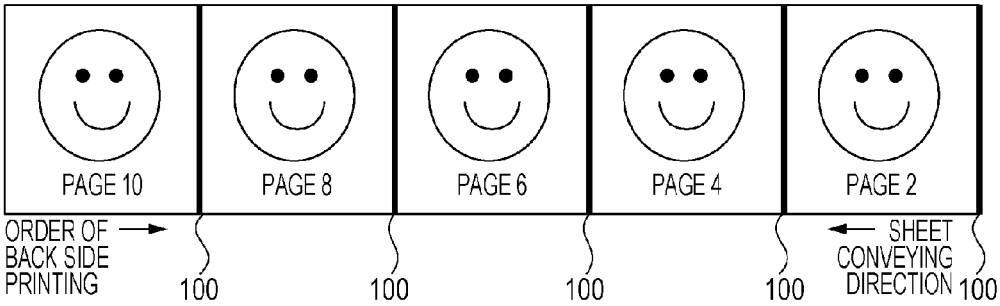

FIGS. 4A, 4B, and 4C illustrate the printing order in the duplex printing mode. FIG. 4A is a schematic view of the front-side printing order. The odd number pages from page 1 to page 9 are sequentially printed by the printing unit 4 on the first surface of the sheet. Reference marks 110 are recorded by the printing unit 4 in the margin regions provided between images on adjacent pages on the first surface. The reference marks 110 are marks that each serve as a position reference to enable precise alignment of an image on the front side and an image the back side when printing an image on the back side of a page on which an image has already been printed on the front side (first surface). A cut mark 100 is recorded at the rear edge of the series of images printed on the first surface. The cut mark 100 is used as a position reference for cutting the sheet with the cutter unit 6 after all images are printed on the first surface.

Figure 6:
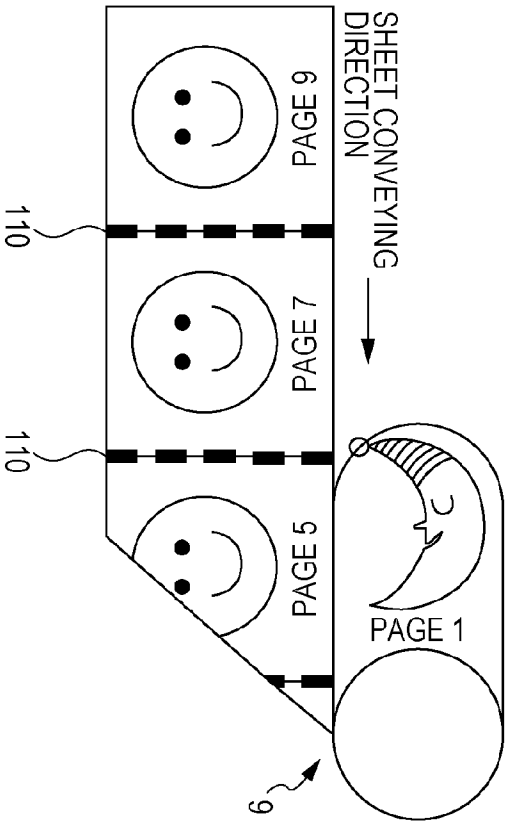
FIG. 6 illustrates a sheet being wound by a reverse unit.

While front-side printing is performed, the sheet is wound by the reverse unit 9. FIG. 6 illustrates the sheet being wound by the reverse unit 9 from the areas on which front-side printed has been performed. FIG. 4B is a schematic view from reversed side of the sheet that has been wound.

Figure 7:
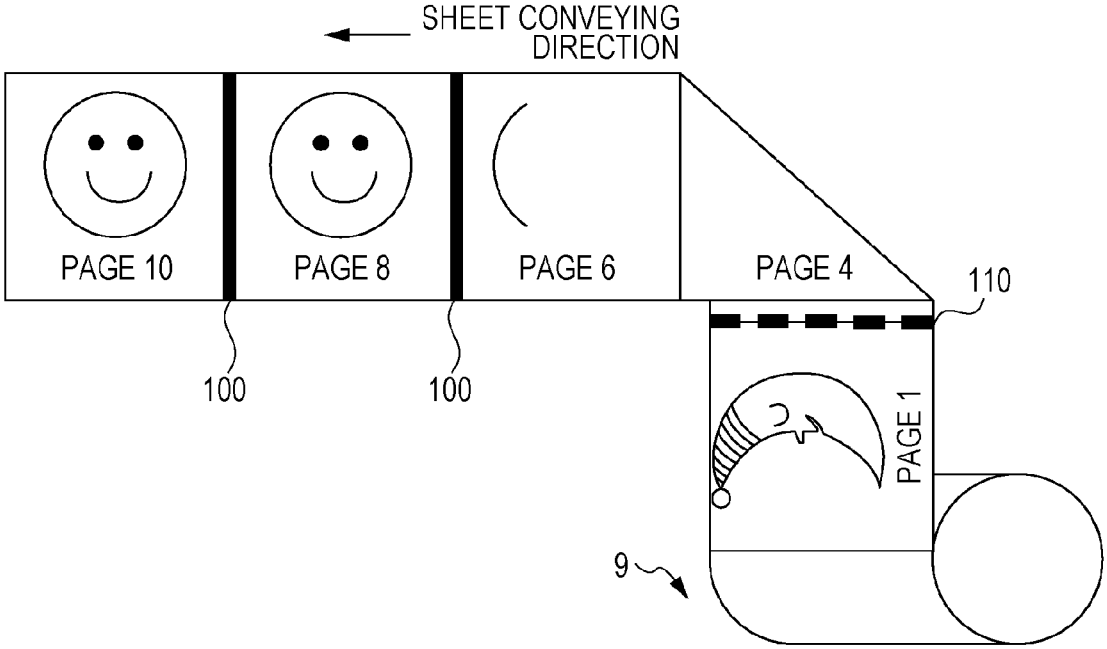
FIG. 7 illustrates printing being performed on a second surface of a sheet.

Subsequently, to perform back-side printing, the reverse unit 9 is rotated in the opposite direction to feed the sheet to the printing unit 4 again. FIG. 4C is a schematic view of the back-side printing order. The even number pages from page 10 to page 2 are sequentially printed by the printing unit 4 on the second surface of the sheet. FIG. 7 illustrates page 6 being printed on the second surface of the sheet sent out from the reverse unit 9. Cut marks 110 are recorded by the printing unit 4 in the margin regions provided between images on adjacent pages on the second surface. The cut marks 100 are each used as a position reference for cutting the sheet by the cutter unit 6 after all images are printed on the second surface.

Figure 5A:
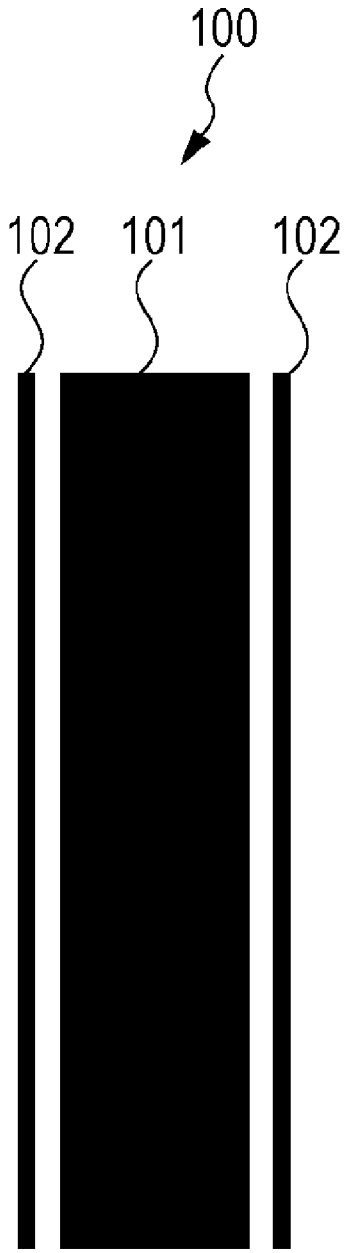
FIGS. 5A and 5B illustrate the shapes of cut mark and alignment mark, respectively.
Figure 5B:
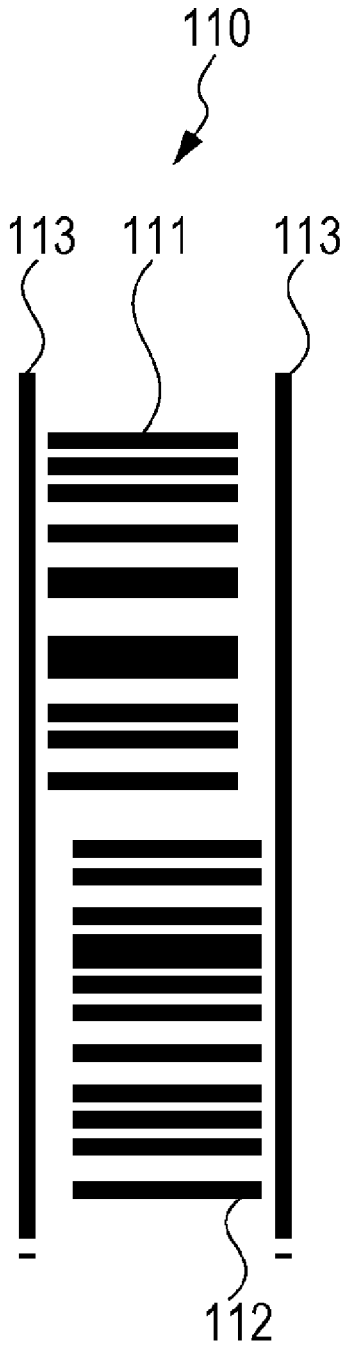

FIGS. 5A and 5B illustrate specific examples of the shapes of and a cut mark 100 and a reference mark 110. FIG. 5A illustrates the shape of the cut mark 100. The cut marks 100 is a linear pattern formed in a thin and long blank extending in the width direction of the sheet. Thin patterns 102 are provided on both sides (upstream and downstream sides) of a thick center pattern 101.

FIG. 5B illustrates the reference mark 110. The reference mark 110 is a pattern formed in the thin and long black extending in the width direction of the sheet. The reference mark 110 is a one-dimensional bar code including identification information for identifying images (code patterns 111 and 112) and including two position patterns 113, which are thin lines disposed on both sides (upstream and downstream sides) of the identification information. The code pattern 111 represents coded identification information (for example, page number) for identifying an image on a page (downstream side, which is the left side in FIG. 5B) that just has been printed. The code pattern 112 represents coded identification information (for example, page number) for identifying an image on a page (downstream side, which is the left side in FIG. 5B) that is to be printed next. The position patterns 113 are used as position references indicating the positions of the images to be printed on the first surface. In this way, each time an image is printed on the first surface of the sheet in front-side printing, the code patterns 111 and 112 representing identification information of an image and the image to be printed next are recorded in predetermined areas (in margin regions provided between adjacent images). The code patterns 111 and 112 are recorded together with the position patterns 113. The usage of the identification information will be described below.

The shape of the reference marks 110 is not limited to that described above. For example, the one-dimensional code pattern may instead be a two-dimensional code pattern, or any other image that is recognizable by the mark reader 18 may be used as a unique shape or character. The identification information does not necessarily have to be visible and, for example, code patterns may be printed using a special ink that reacts when irradiated with black light. Moreover, the identification information may be embedded in the printed images as patterns that are difficult to visibly recognize. So long an image can be uniquely identified, the identification information may be provided in various different forms.

During back-side printing of the above-described sequence, an error causing an interruption in the printing may occur, and to eliminate such an error the sheet is cut. Here, the error is sheet conveying jamming (simply referred to as jamming) that occurs in the sheet conveying path. Furthermore, errors that interrupt printing may occur due to a lack in ink supply to the print-head unit 14 caused by an ink shortage or a defect in the ink supply system or a defect in the print-head unit 14 (mis-discharge due to nozzle clogging, failure of the heads, or wiring disconnection). A print control method for recovering from such an error will be described below with reference to the flow chart in FIG. 8.

Figure 8:
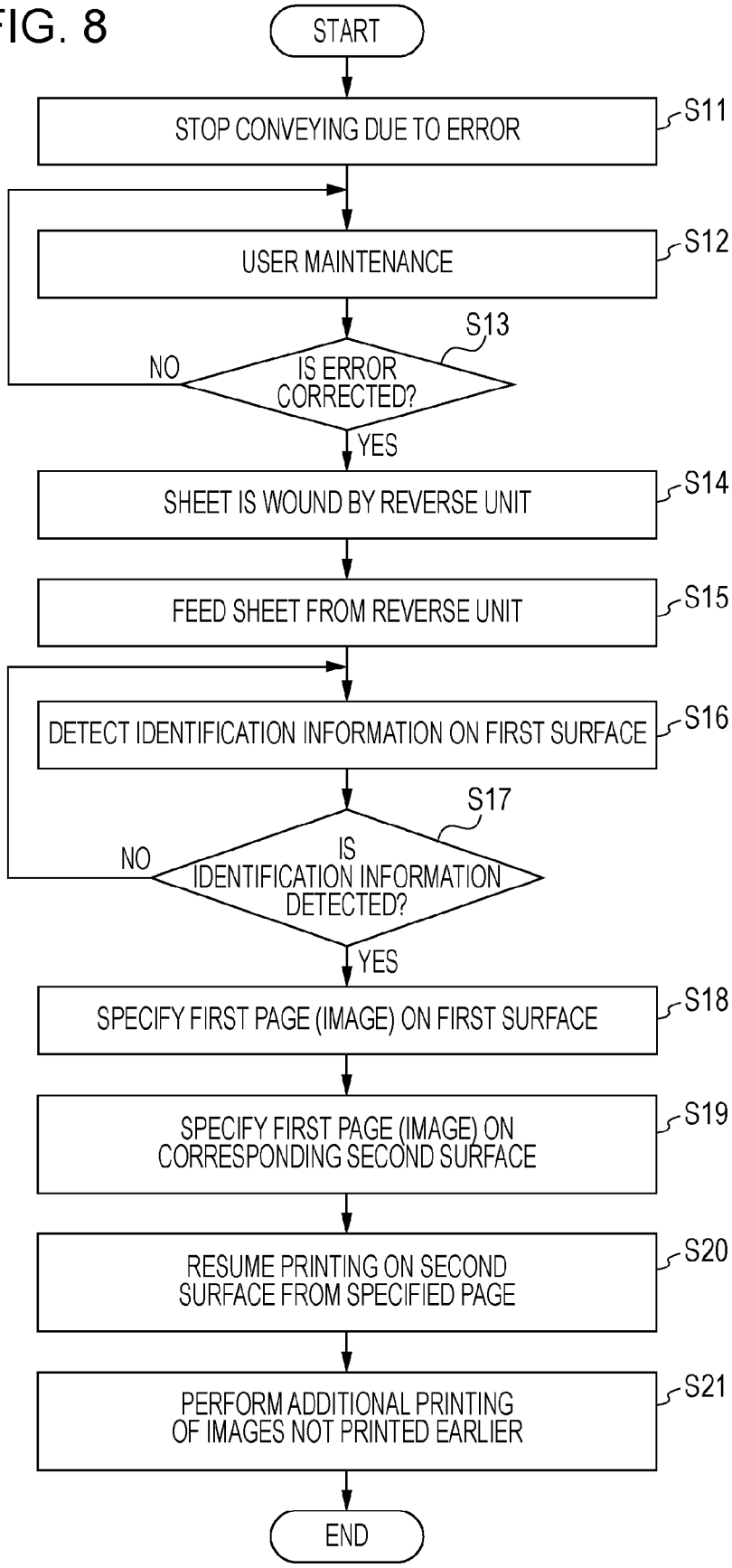
FIG. 8 is a flow chart illustrating the recovery process performed when an error occurs.
Figure 9:
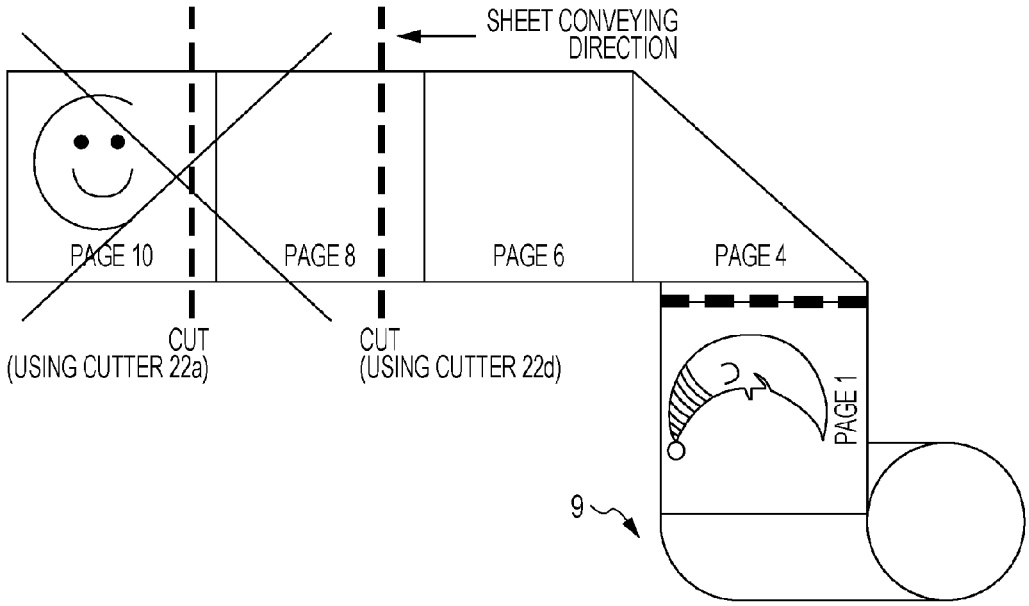
FIG. 9 is a schematic view illustrating printing interruption due to an error occurring during back-side printing.

When an error occurs while performing printing in a duplex printing mode, the printing apparatus stops conveying the sheet (Step S11 in FIG. 8). FIG. 9 is a schematic view of an interruption in printing due to an error that occurred during back-side printing in the duplex printing mode. Here, the sheet was jammed when printing page 10 on the second surface.

The printing apparatus detects the error and displays the error condition and the measure to be taken (for example, the position where the jamming occurred and how to remove the jammed sheet) on the display of the operating unit 15. Instructions for the user to remove the jammed sheet are displayed to facilitate maintenance (Step S12 of FIG. 8).

Figure 11:
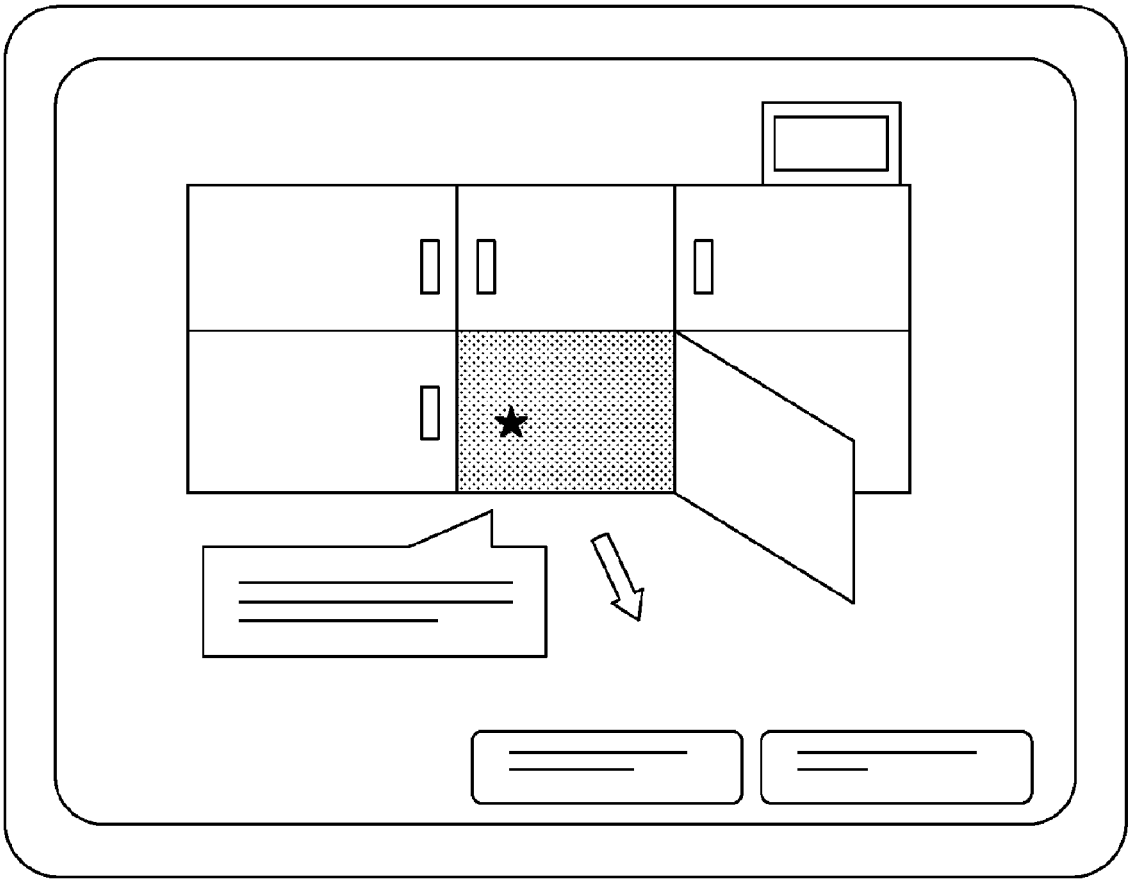
FIG. 11 illustrates an example of a maintenance screen displayed on a display unit.

FIG. 11 illustrates an example maintenance screen displayed on the display. The position where the jamming occurred and the apparatus door for accessing the jamming is graphically displayed. The maintenance steps are displayed through characters and shapes. In accordance with the displayed maintenance steps, the user uses one of the manual cutters 22*a* to 22*d* closest to the position of the jamming to cut the sheet in order to eliminate the jamming. In the example of FIG. 9, the sheet is jammed in the decurling unit 2 or the skew correction unit 3, and the user uses the manual cutters 22*a* and 22*b* respectively upstream and downstream of the position where the jamming occurred. In this example, the sheet is cut at two positions in pages 8 and 10 on the second surface. After cutting, the sheet fragment obtained from between the two cutting positions (the sheet on left of the cutting position of the manual cutter 22*d* in the drawing) is removed and discarded by the user. The sheet remaining downstream of the manual cutter 22*a* is also ejected and removed manually by the user or by the conveying mechanism in the apparatus.

The removal of the sheet is recognized by the printing apparatus through an instruction provided by the user or by a sensor (Step S13 in FIG. 8).

After the error is eliminated, the reverse unit 9 rotates in the opposite direction so that the sheet sent out toward the printing unit 4 is rewound such that the front edge of the sheet returns to the reverse unit 9 (Step S14 in FIG. 8). At this time, the images (pages 1, 3, and 5) printed on the first surface of the sheet upstream of the cutting position of the upstream manual cutter 22*d* and the reference marks (between pages 5 and 7 and further upstream) are not damaged. Thus, it is possible to continue back-side printing on the second surface, i.e., the back side of these undamaged areas.

After resuming of back-side printing is instructed, the sheet rewound by the reverse unit 9 is sent out and fed to the printing unit 4 again by rotating the reverse unit 9 the opposite direction again (Step S15 in FIG. 8). The front section of the sheet being sent out is part of page 7 cut by the manual cutter 22*d*.

While the sheet is sent to the printing unit 4, the mark reader 18 attempts to read, from the back side of the sheet, the identification information (code patterns 111 and 112) recorded at predetermined positions on the first surface (Step S16 in FIG. 8). When the code patterns 111 and 112 pass the reading position of the mark reader 18, the identification information is detected (Step S17 in FIG. 8). The code pattern recorded closest to the front edge of the first surface of the sheet is detected first. The page corresponding to the first image on the first surface is specified on the basis of the identification information detected first (Step S18 in FIG. 8). In the case illustrated in FIG. 9, the upper code pattern 111 represents page 7, and the lower code pattern 112 represents page 5. Therefore, the first image is specified as page 5. That is, in most cases, since the image immediately before the first code pattern 111 is an imperfect image cut in the middle, the next image is determined to be the first image on the first surface of the sheet.

Rarely, the cutting position of the cutter unit 6 is set in a margin region, where a reference mark 110 is provided. In such a case, the image immediately after the cutting position is set as the first image on the first surface of the sheet if at least one item of the identification information (code pattern 111 or 112) in the cut margin region can be read by the mark reader 18. On the other hand, if neither pattern code 111 nor 112 can be read by the mark reader 18, instead of the image immediately after the cutting position, the image immediately after a readable pattern code is set as the first image on the first surface of the sheet. That is, the image immediately after the cutting position in a margin region can be set as the first image so long as at least one of the two code patterns 111 and 112 in the margin region is readable. In other words, the reading rate of identification information provided in a margin region in which the cutting position is set is increased to decrease the number of printed images that are wasted.

In this way, the identification information recorded in the front edge section on the first surface of the sheet fed again from the reverse unit 9 is read by the mark reader 18, and the page (image) to be printed on the second surface when printing is resumed is specified on the basis of the read result (Step S19 in FIG. 8). In the example in FIG. 9, the first image on the first surface of the sheet is page 5. Therefore, page 6, which is on the back side of page 5, is specified as the image to be printed at first when back-side printing on the second surface is started.

The mark reader 18 is not limited to an image sensor that reads images. For example, the mark reader 18 may be a window provided near the reverse unit 9 so that the user can visibly identify the identification information or directly identify the image. In such a case, the user uses the operating unit 15 to specify the page or image to be printed when printing is resumed.

Since the first image on the first surface of the sheet can be identified so long as at least one of the two images sandwiching a margin region is specified on the basis of identification information, only one of the code patterns 111 and 112 may be provided. Furthermore, instead of identification information of the page (image) on the first surface, the code patterns may directly represent identification information of the page (image) on the second surface, i.e., the back side. In this way, the two steps of specifying an image on the first surface at first and then specifying an image on the second surface (Steps S18 and S19 in FIG. 8) may be replaced by a single step. Accordingly, the identification information may be information for specifying at least one of the images before and after the margin region or information for determining the image to be printed on the back side of the image before or after the margin region.

After the first page (image) on the second surface to be printed in back-side printing is specified, back-side printing is resumed (Step S20 in FIG. 8). Images and cut marks 100 are sequentially printed on the back side of the corresponding images printed on the first surface of the sheet. At this time, the mark reader 18 detects the position patterns 113 of the reference marks 110 recorded on the first surface and determines the positions of the images to be printed on the second surface on the basis of the detection timings of the position patterns 113. The cut-mark sensor 19 of the cutter unit 6 detects the cut marks, and the cutter 20 cuts the sheet into pieces corresponding to unit images. The sheet fragments corresponding to the margin regions are ejected to the waste box 17. The sheet cut after duplex printing is performed is processed at the information recording unit 7 and the drying unit 8 and is ejected into the ejection unit 12 as printouts.

In the above-described sequence for error recovery, part of the images to be printed is not output as printouts due to the error. Thus, the images that were not printed are printed later through an additional printing process (Step S21 in FIG. 8). This additional printing process may be performed automatically by the apparatus or may be performed in response to an instruction from the user. In the example in FIG. 9, pages 7 and 9 on the first surface and pages 8 and 10 on the second surface are not printed. Accordingly, additional duplex printing is performed through the above-described steps. First, pages 7 and 9 are printed through front-side printing, and then pages 8 and 10 are printed through back-side printing to print the images that were not printed earlier.

As described above, even when printing is interrupted during back-side printing in the duplex printing mode, by resuming back-side printing while saving front-side printed sheets as many as possible, waste in sheets and ink can be minimized.

Figure 10:
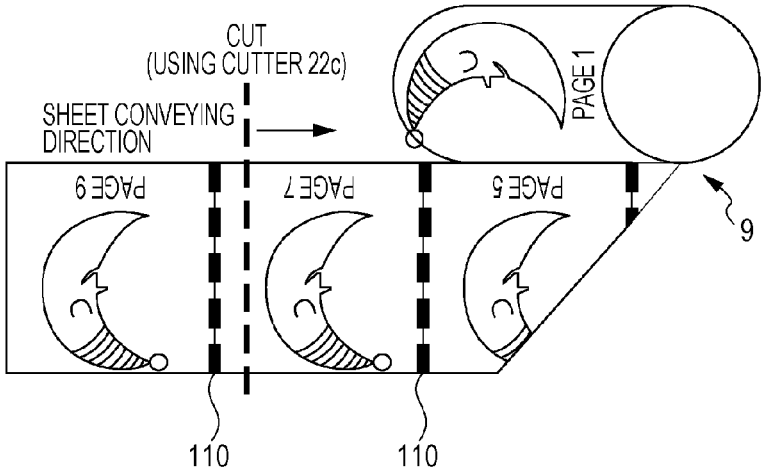
FIG. 10 is a schematic view illustrating printing interruption due to an error that has occurred during front-side printing.

In the above, a case in which an error occurs during back-side printing in the duplex printing mode is described. However, there are cases in which errors occur during front-side printing. FIG. 10 is a schematic view of printing being interrupted due to an error that occurred during front-side printing in the duplex printing mode. An example case in which jamming occurs while the reverse unit 9 is taking up the sheet on which printing has been performed on the first surface will be described. When an error occurs, the printing apparatus stops convey the sheet, displays the position where jamming occurred on the display of the operating unit 15, and urges the user to remove the jammed sheet.

In response, the user uses at least one of the manual cutters 22*a* to 22*d* closest to the jamming position to cut the sheet to eliminate the jamming. In the example of FIG. 10, jamming occurred in the drying unit 8, and the user uses the manual cutter 22*c*, which is closest to the jamming position. In this example, the sheet is cut in the middle of page 7 on the first surface, and the sheet on the upstream side of the cutting position of the manual cutter 22*c* (the partial image on page 7 and the image on page 9) is removed and discarded by the user. When the sheet is removed, the reverse unit 9 rotates again to continue to wind the sheet. At this time, the printed images (pages 1, 3, and 5) and the reference marks 110 on the sheet on the downstream side of the cutting position of the manual cutter 22*c* are not damaged. Thus, it is possible to continue back-side printing on the second surface, i.e., the back side of these undamaged areas.

After the sheet is completely wound by the reverse unit 9, back-side printing is started. The front section of the sheet being sent out is part of page 7 cut by the manual cutter 22*c*. While the sheet is sent to the printing unit 4, the mark reader 18 attempts to read, from the back side of the sheet, the identification information (code patterns 111 and 112) recorded at predetermined positions on the first surface. The page corresponding to the first image on the first surface is specified on the basis of the identification information detected first. The image to be printed on the second surface in an area on the back side of the first image on the first surface of the sheet identified in this way is specified. The process of specifying the image is the same as that described with reference to FIG. 11. Then, images are sequentially printed on the second surface.

As described above, even when printing is interrupted while the reverse unit 9 is wound or sending out the sheet, by resuming back-side printing while saving front-side printed sheets as many as possible. In this way, waste in the sheet and ink can be minimized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042336 filed Feb. 26, 2010, which is hereby incorporated by reference herein in its entirety.

What is claimed is:

1. An apparatus for duplex printing comprising:

a sheet feeding unit configured to feed a continuous sheet;

a printing unit configured to perform printing on the sheet;

a reverse unit configured to reverse the sheet for the duplex printing;

a reader configured to read identification information formed on the sheet; and a control unit, wherein the control unit controls the apparatus such that, the printing unit prints a plurality of images and identification information for identifying each of the images, on a first surface of the sheet fed from the sheet feeding unit, the reverse unit stores the sheet printed on the first surface and feeds the reversed sheet to the printing unit, the printing unit prints a plurality of images on a second surface that is a back of the first surface of the sheet fed from the reverse unit, and, when printing is interrupted by an error and before resuming printing, the reader reads the identification information formed on the first surface of the sheet fed from the reverse unit, and the control unit specifies an image to be printed on the second surface for resuming based on the read identification information.

2. The apparatus according to claim 1, wherein the reverse unit stores a part of the sheet with the images printed on the first surface in the reverse unit when maintenance is carried out after the error occurred.

3. The apparatus according to claim 2, further comprising:

cutters disposed in different positions in a sheet conveying path, the cutters are used to cut the sheet when the maintenance is carried out.

4. The apparatus according to claim 1, wherein the identification information is recorded by the printing unit as a code pattern, an image of a unique shape, or a character in a margin region provided between two adjacent images on the sheet.

5. The apparatus according to claim 4, wherein the identification information includes information for specifying at least one of the images sandwiching the margin region or information for specifying an image to be printed on a back side of one of the adjacent images sandwiching the margin region.

6. The apparatus according to claim 4, wherein the identification information is recorded together with an alignment pattern provided as a position reference for aligning an image on the first surface and an image on the second surface.

7. The apparatus according to claim 1, wherein the error causing an interruption in the printing, requiring cutting of the sheet to eliminate the error, and occurring while storing the sheet with images printed on the first surface in the reverse unit or while performing printing on the second surface.

8. The apparatus according to claim 1, wherein the error is one of jamming of the sheet, shortage of ink supplied to a print head, and a failure of the print head.

9. The apparatus according to claim 1, wherein the control unit controls to perform additional printing to print images that were not output due to the error.

10. The apparatus according to claim 1, wherein the reverse unit includes a winding rotary member, and wherein the sheet printed on the first surface is temporarily wound around the winding rotary member, subsequently, the winding rotary member rotates in an opposite direction to feed the wound sheet to the print unit.

* * * * *